United States Patent [19]

Spurrell et al.

[11] Patent Number: 4,974,772

[45] Date of Patent: Dec. 4, 1990

[54] CONTAINER

[75] Inventors: Robert M. Spurrell; Terry B. Jordan, both of Auburn; Warren R. Hensey, Battle Ground, all of Wash.

[73] Assignee: Weyerhaeuser Company, Tacoma, Wash.

[21] Appl. No.: 443,995

[22] Filed: Nov. 30, 1989

[51] Int. Cl.[5] ..... B65D 5/40

[52] U.S. Cl. ..... 229/125.42; 229/3.1; 229/920

[58] Field of Search ..... 229/3.1, 920, 125.42; 206/621.1, 621.2, 631.3

[56] References Cited

U.S. PATENT DOCUMENTS

| | | | |
|---|---|---|---|
| 1,206,839 | 12/1916 | Gruenberg | 229/920 |
| 3,232,516 | 2/1966 | Arslanian | 229/125.42 |
| 3,355,083 | 11/1967 | Wilcox | 206/631.3 |
| 3,366,308 | 1/1968 | Phillips, Jr. | 206/631.3 |
| 3,604,317 | 9/1971 | Bonn | 229/3.1 |

*Primary Examiner*—Gary E. Elkins

[57] ABSTRACT

The purpose of the present invention is to prevent or minimize the damage to a carton caused by sudden impact. This damage results most often from the cartons being dropped from some height. The type of carton damage is usually corner fracture. The tensile forces applied to the corner as the carton hits causes a tear to form at the base of the vertical score line where the carton folds to make the bottom corner. A single score line is formed in and at the side of the side panels of a carton. Each score line extends outwardly from each side of the side vertical score lines which define the side panels of the carton. The purpose of these score lines is to induce a fold to form preferentially at the intersection of the score line and the vertical score line and away from the carton bottom corner when the carton is dropped or suddenly shocked. Each of the score lines should be long enough and placed a distance from the bottom wall to induce the fold line to form preferentially away from the bottom corner.

16 Claims, 13 Drawing Sheets

CONTAINER

BACKGROUND OF THE INVENTION

Arslanian U.S. Pat. No. 3,232,516 discloses a paperboard container having side walls defined by vertical score lines. A series of score lines, described as shock absorbing score lines, extend outwardly from each of these vertical score lines.

The Arslanian patent explains that the continuous vibrations and shock situations in the bottling plant and during transportation create a fatigue and cracking of the container coating because the side walls of the container are subject to pressure from the contained liquid which causes either constant or abrupt breathing of the side walls. Breathing is an in and out movement of the side walls. The effect is greatest at the bottom corners of the carton.

The placement and number of the score lines are shown in the drawings of the Arslanian patent. The score lines are shown extending completely across a side panel in FIGS. 7 and 8 or only partially across a side panel in FIGS. 1–6. The score lines are shown parallel to the bottom wall in FIGS. 1–4 and 7, at an angle to the bottom wall in FIG. 5 or as a combination of score lines parallel to the bottom wall and at an angle to the bottom wall in FIGS. 6 and 8. In each of the embodiments shown, there are a plurality of score lines at each location. There are 5 score lines at a location if the score lines are parallel to the bottom wall or 4 score lines at a location if the score lines are at an angle to the bottom wall.

The placement and number of the score lines are also described in the claims and the specification of the Arslanian patent.

The claims require that the score lines be located solely in the area more than 10% and not more than 25% of the height of a side panel of the carton, and the length of the score lines be at least 10% and not more than 25% of the width of a side panel of the carton. Claims 2 and 5 require the score lines to be at least 4 in number. Claim 2 requires and claim 5 appears to require the score lines to be at least ⅛" apart. In column 4 of the specification the score lines are described as being 1" long and approximately 5/16" apart, and starting 1" above the bottom of the container.

The patent indicates that this placement of the score lines keeps them in non-critical areas of the container walls, areas in which the vibrational forces will oppose each other. The purpose of the score lines is to prevent the smiles 58, shown in FIG. 14, forming at the bottom corners of the container by reducing the concentration of forces in the bottom corners of the side panels.

BRIEF SUMMARY OF THE INVENTION

There are two problems associated with the handling of liquid filled cartons.

One problem is the fatigue failure caused by moving the cartons within the plant or to the ultimate destination of the filled cartons. This was noted in the Arslanian patent and a solution was proposed.

The other is damage caused by a sudden shock. A normal type of sudden shock is dropping the carton from some height. This usually results in a type of carton damage called corner fracture. The tensile forces applied to the bottom carton corner as the carton hits a surface causes a tear to form at the base of the vertical score line where the carton folds to make the bottom corner. The Arslanian patent did not address this form of damage.

The problem presented to the inventors was twofold. The corner fracture damage should be minimized or eliminated and the solution to this sudden impact problem should not significantly increase fatigue damage.

Their solution was a score line, called a bumper score line, extending outwardly from each side of the vertical score lines which define the sides of the side panels of the carton. The bumper score lines are formed in each of the side panels. There is a single bumper score line at each location. There is no bumper score line in the laminated sealing joint of the carton.

The purpose of the bumper score line is to minimize or eliminate corner fracture damage. The bumper score line is designed to prevent sudden shock failures that cause the combined outer paperboard/coating structure to tear when a carton is dropped. It does this by inducing a fold line to form in the side wall of the carton preferentially at the intersection of the bumper score line and the vertical score lines instead of at the bottom corners of the carton when the carton is dropped or suddenly shocked.

The puprpose of the bumper score line is not to prevent a smile from forming but to direct its formation to an area above the carton corner. This relieves the pressure on the corner enough to prevent or significantly decrease the likelihood of fracture.

Each of the bumper score lines should be long enough to induce the fold line to form preferentially at the intersection of the bumper score line and the veticl score line. A bumper score line approximately ¼" long has induced the fold line to form preferentially at the intersection but a length of ⅛" may be long enough to induce the fold line to form at the intersection. A bumper score line longer than ¼" should induce the fold line to form preferentially at the intersection. A bumper score line ⅜" or ½" long should induce the fold line to form preferentially at the intersection instead of at the bottom corner of the carton. A bumper score line extending the width of the side panel should induce the fold line to form preferentially at the intersection instead of at the bottom corner of the panel.

The placement of the intersection of each of the bumper score lines and the vertical score lines in relation to height of the carton is also critical. The intersection of the bumper score line and vertical score line should be placed above the bottom of the container a distance which will promote the formation of the fold line preferentially at the intersection instead of at the bottom corner of the carton. A distance of ¼" above the bottom wall of the container has promoted the formation of the fold line at the intersection. It is believed that this distance may be between ⅛" and ½" above the bottom of the carton, and still promote the fold line to be formed preferentially at the intersection instead of at the bottom corner of the carton. A distance of ¼" to ⅜" above the bottom of the container is preferred.

Again the purpose of the bumper score lines are to induce the fold line to form preferentially at the intersection of the bumper score and the vertical score line forming the side of the carton side panel. The direction or shape of the bumper score line is important only in helping to induce the fold line to form at the intersection. The bumper score line may be parallel to the bottom of the container, at an angle to the bottom of the container, straight or curved upwardly or downwardly from its intersection with the vertical score line.

It was found in tests that the present bumper score lines drammatically reduced sudden impact damage to ½ that of cartons using the Arslanian design and to ⅓ that of control cartons. It was further found that the design did not adversely effect the improvement against fatigue damage of the Arslanian design. There was no significant statistical difference between the Arslanian design and the bumper score lines in reducing fatigue damage to the cartons.

DETAILED DESCRIPTION

A gable topped container is exemplary of the style of liquid containing carton which the present invention may be used. The carton may be a partial gable topped container or a flat topped container. These types are well known in the liquid carton field and there are many patents showing the various styles of top and bottom construction of such containers. The Arslanian patent is typical of such disclosures. Any bottom or top constuction may be used with the present invention.

Figure 3:
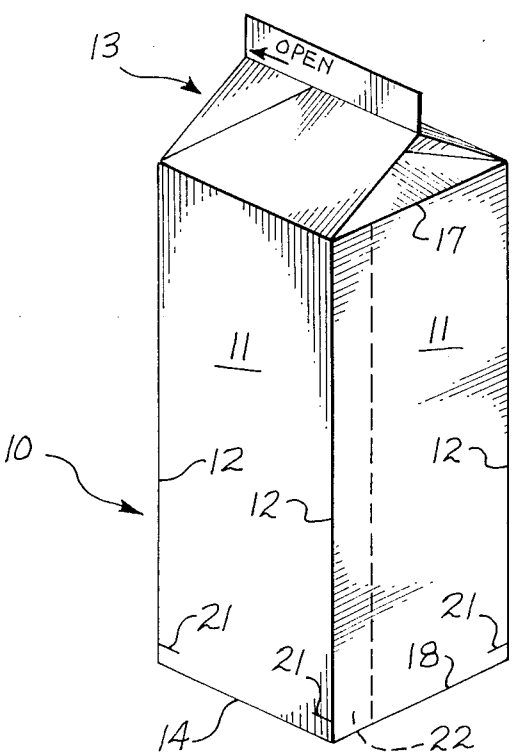
FIGS. 2 and 3 are isometric views of a carton having the single score line of the present invention.
Figure 2:
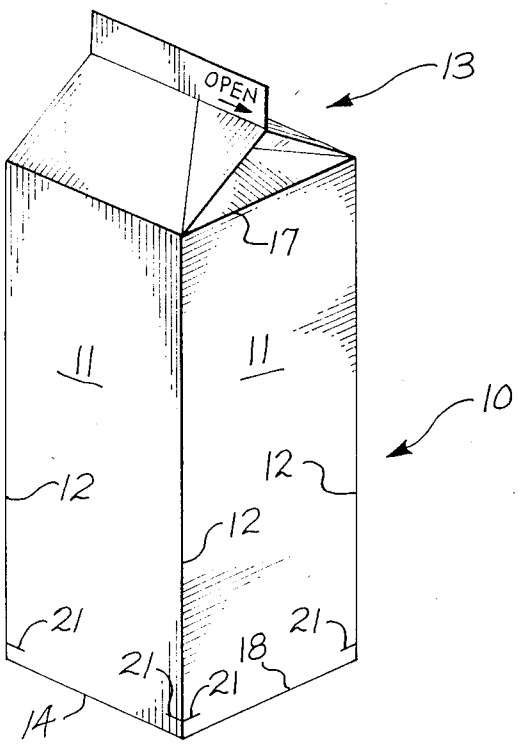

The typical gable topped paperboard carton is of the style shown in FIGS. 2 and 3. The container 10 has four side panels 11. The panels 11 are enjoyed by vertical corner score lines 12. A gable top 13 is formed from upper extensions of the side panels 11. A bottom wall 14 is formed from lower extension of the side panels 11. The upper and lower extensions are sealed together to form the gable top and bottom wall.

Figure 1:
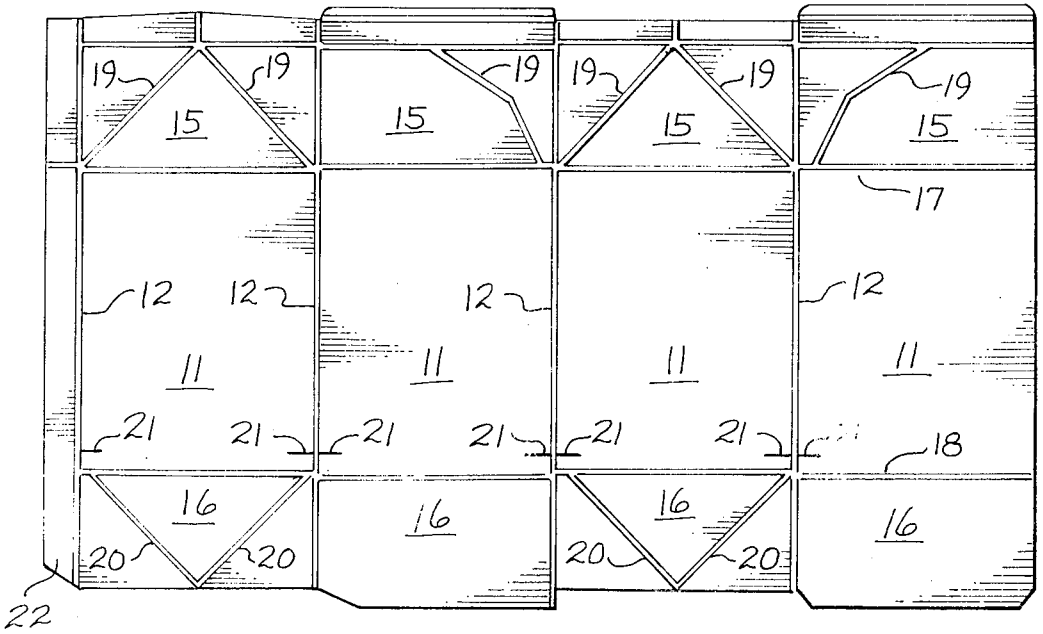
FIG. 1 is a top plan view of a blank for a container using the score lines of the present invention.

The blank for the container of FIGS. 2 and 3 is shown in FIG. 1. The upper panels 15 and the lower panels 16 are connected to the side panels 11 by score lines 17 and 18 respectively. The upper panels 15 are connected to each other and the lower panels 16 are connected to each other by extensions of the score lines 12. Angular score lines 19 in the upper panels 15 allow these panels to be formed into the gable top 13 shown in FIGS. 2 and 3. Two of the angular score lines 19 are shown as being dog-legged. This is a standard construction on a gallon carton. These score lines may be straight instead of dog legged as is normal on smaller cartons.

The angular score lines 20 in the lower panels 16 allow these panels to be folded inwardly and sealed together to form the bottom wall 14. Again there are many styles of bottom walls for these containers.

The bumper score lines 21 extend outwardly from each side of the vertical score lines 12. There is not score line at the manufacturer's joint, the sealing of the sealing joint 22 to the opposite side, upper and lower panels. There is a single bumper score line 21 at each location.

The intersection of each bumper score line 21 and the vertical score line 12 is located far enough above the bottom of the container to cause a fold line to form preferentially above the bottom corner of the container. The intersection can be from ⅛" to ½" above the bottom wall or the score lines 18 defining the bottom wall. A distance of ¼" to ⅜" is prefered. At each location there is a single score line 21 extending from the vertical score line 12 in each direction from the score line 12. There is no score line 21 on the laminated carton joint. This is shown in FIG. 3.

Each of the bumper score lines 21 is long enough to cause a fold line to form preferentially at the intersection of the bumper score line and the vertical score line instead of at the bottom corner of the container. A bumper score line approximately ¼" long has induced a fold line to form preferentially at the intersection of the bumper score line and the vertical score line but a length of ⅛" may be long enough to induce the fold line to form preferentially at the intersection. A bumper score line longer than ¼" should induce the fold line to form preferentially at the intersection. A bumper score line ⅜" or ½" long should induce the fold line to form preferentially at the intersection instead of at the bottom corner of the carton. A bumper score line extending the width of the side panel should induce the fold line to form preferentially ast the intersection instead of at the bottom corner of the panel. Again, the purpose of the bumper score line is to create a crease or fold line above the corner of the carton, reducing the tendency of the container paperboard to fracture.

Figure 4:
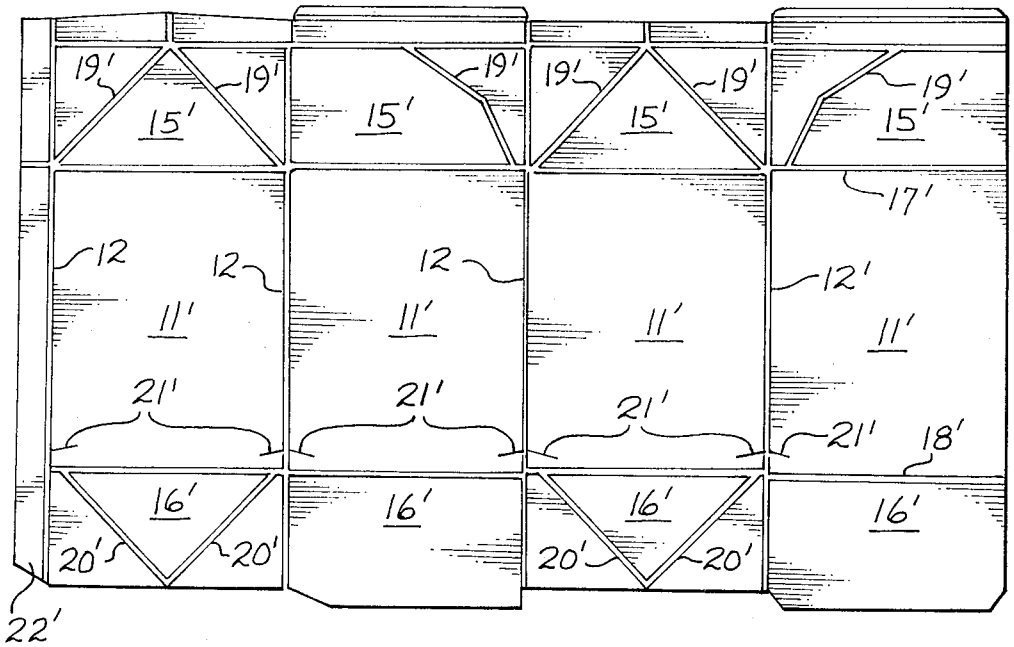
FIGS. 4–6 show a first modification of the present invention, FIG. 4 being a top plan view of the blank and FIGS. 5–6 being isometric views of the carton.
Figure 6:
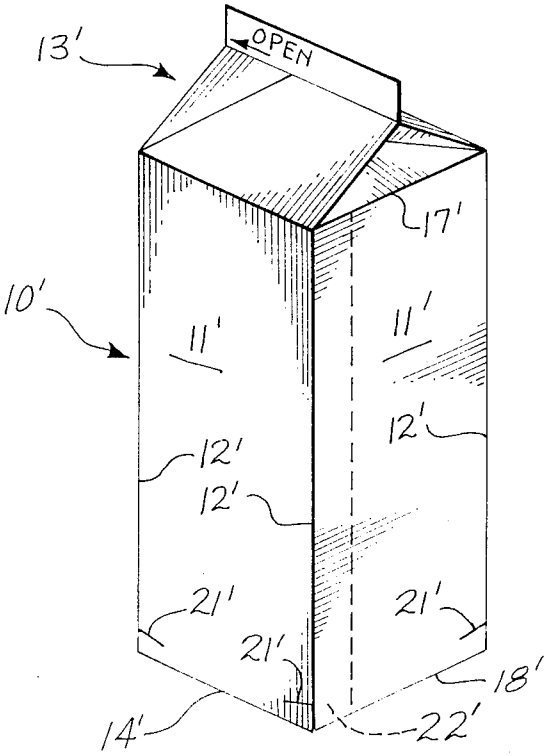
Figure 5:
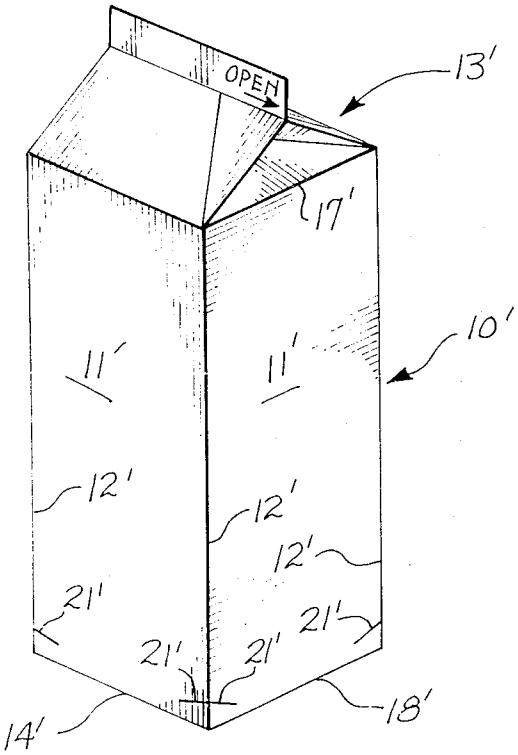
Figure 7:
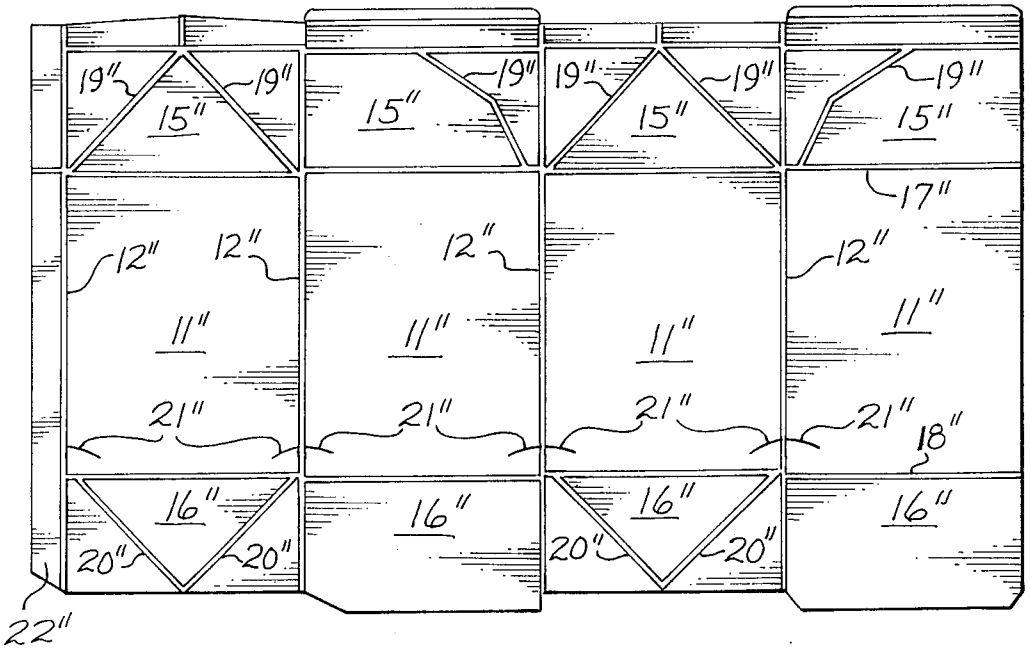
FIGS. 7–9 show a second modification of the present invention, FIG. 7 being as top plan view of the blank and FIGS. 8–9 being isometric views of the carton.
Figure 9:
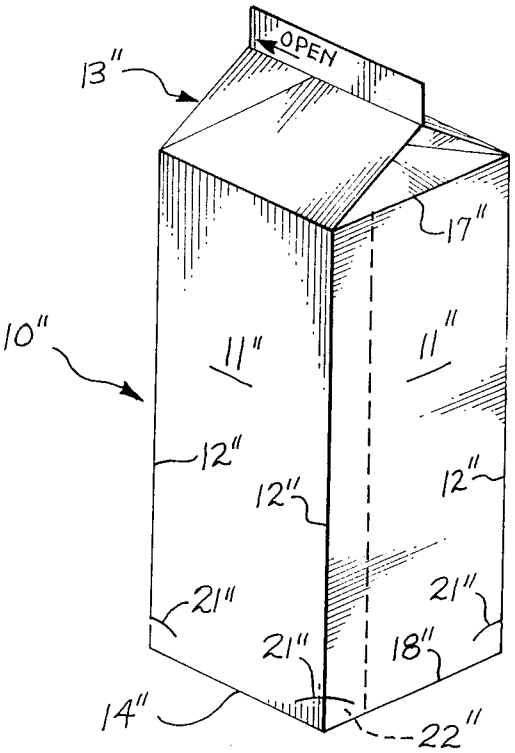
Figure 8:
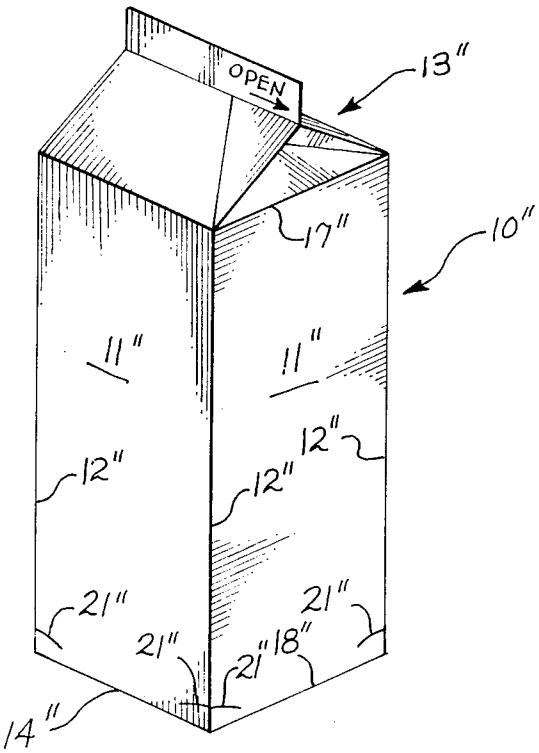
Figure 10:
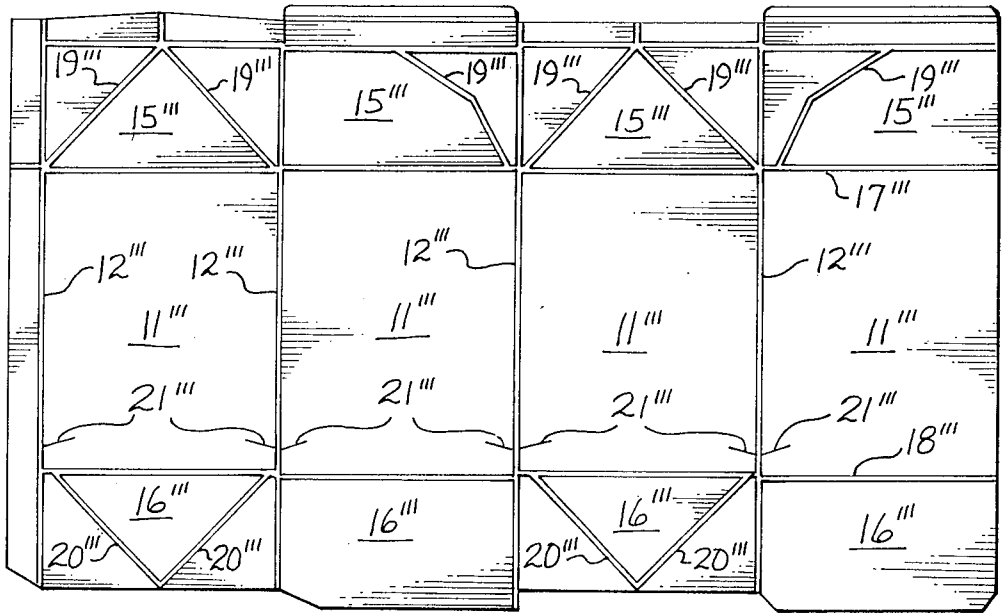
FIGS. 10–12 show a third modification of the present invention, FIG. 10 being as top plan view of the blank and FIGS. 11–12 being isometric views of the carton.
Figure 12:
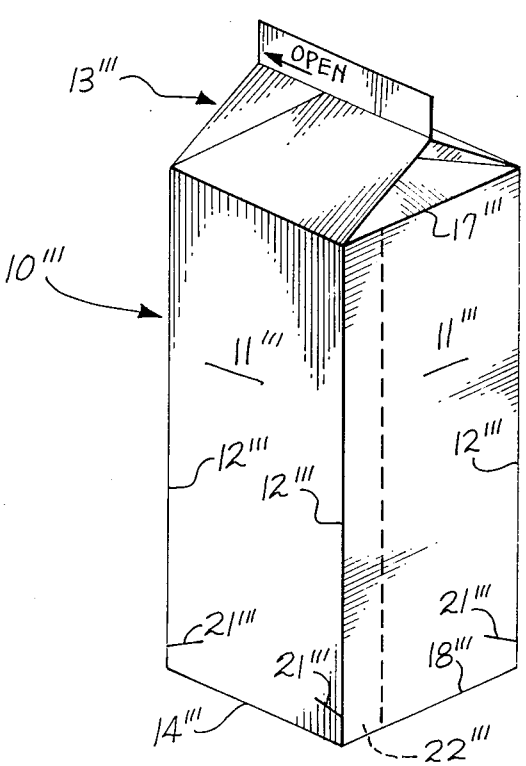
Figure 11:
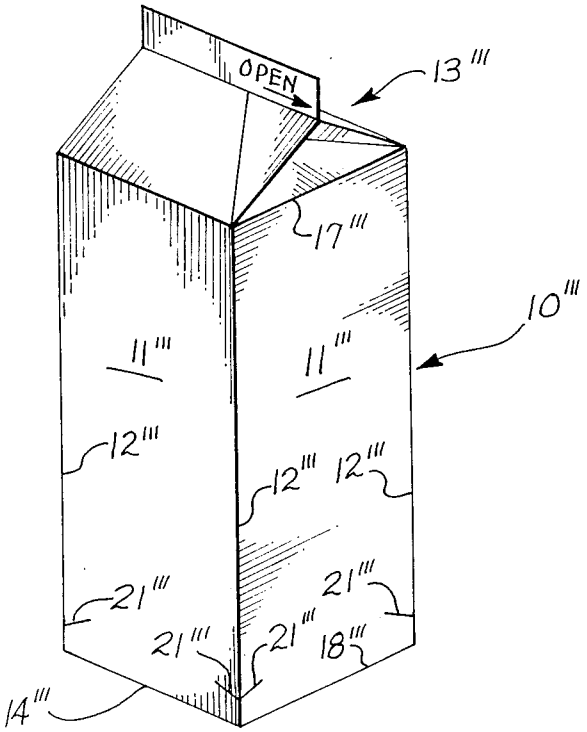
Figure 13:
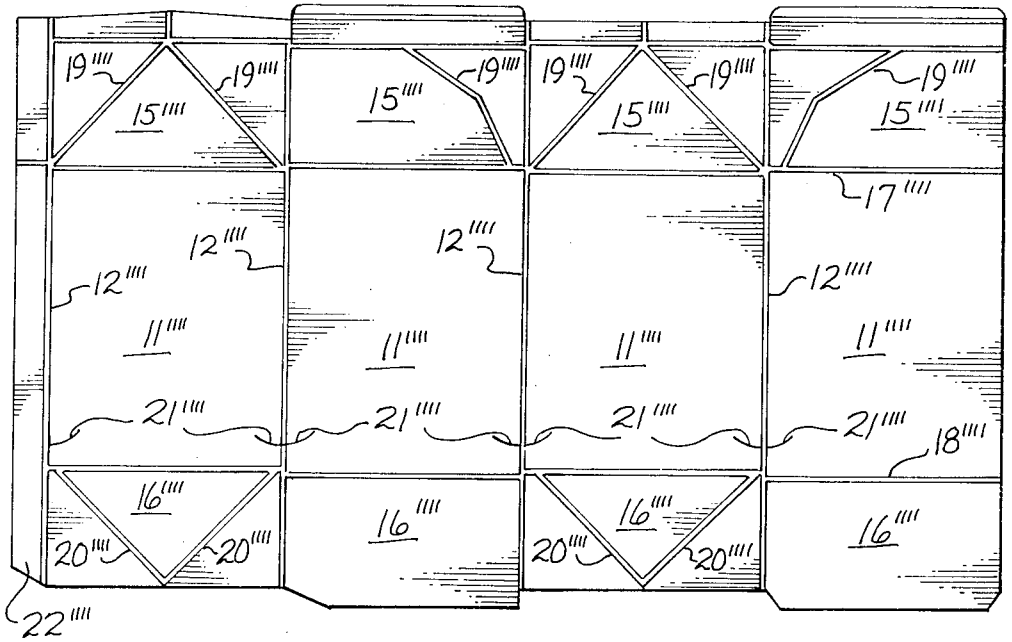
FIGS. 13–15 show a fourth modification of the present invention, FIG. 13 being a top plan view of the blank and FIGS. 14–15 being isometric views of the carton.
Figure 15:
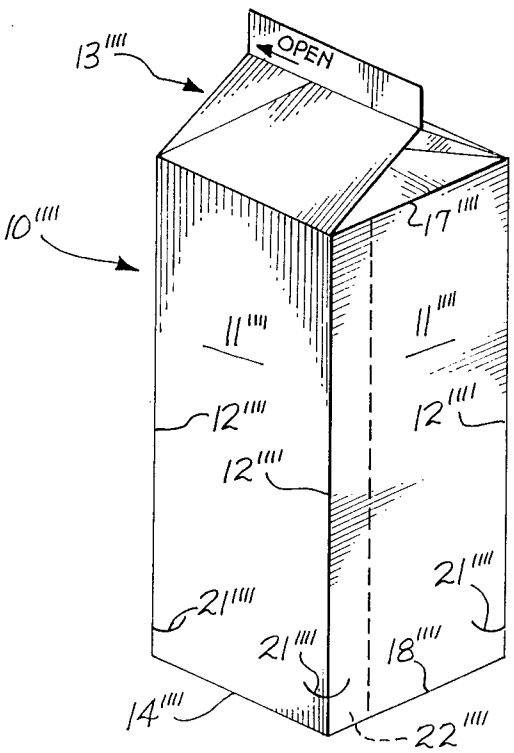
Figure 14:
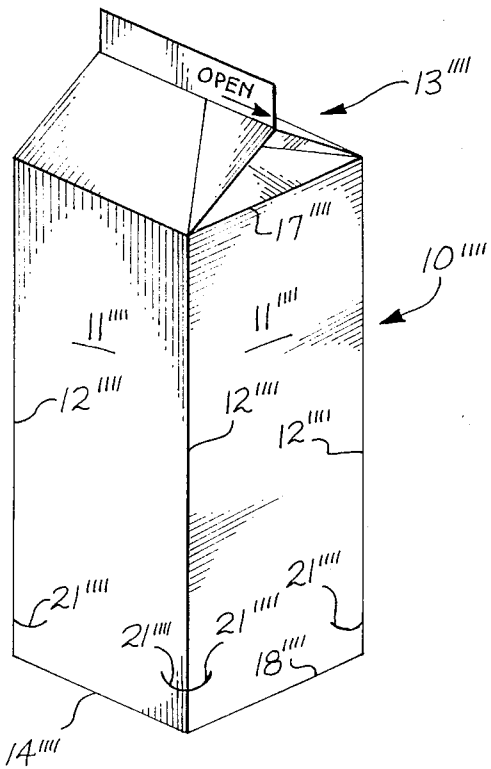

The single score line may take one of several forms. FIGS. 4 though 15 illustrate these modifications. The Figures are the same as FIGS. 2 and 3 and the reference numerals are the same. FIGS. 4–6 illustrate a carton in which the bumper score lines 21' angle downwardly toward the bottom wall of the carton. FIGS. 7–9 illustrate a carton in which the bumper score lines 21" are curved downwardly toward the bottom wall of the container. FIGS. 10–12 illustrate a carton in which the bumper score lines 21''' angle upwardly from the bottom wall of the carton. FIGS. 13–15 illustrate a carton in which the bumper score lines 21'''' curve upwardly away from the bottom wall of the carton.

The bumper score line design was tested and compared to other designs. The other designs were a control having no score lines, the Arslanian patent design and a special design devised for this test by the inventor which used circular scores. The four designs used are shown in FIGS. 16–19.

Figure 16:
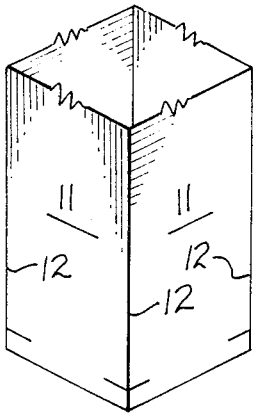
FIGS. 16–19 are isometric views of the bottom portions of containers showing the cartons being tested.
Figure 17:
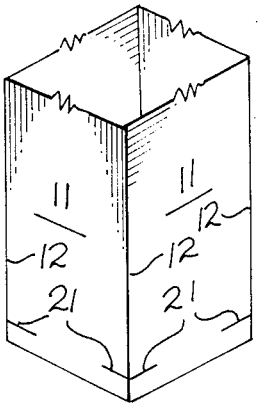

The bottom section of the control container is shown in FIG. 16. It has no horizontal score lines between the top and bottom score lines 17 and 18.

The second test design was a carton having the bumper score lines of the present invention. The bottom section of the carton having these bumper score liens in shown in FIG. 17. The score lines 21 were at a height of ¼" above the bottom of the carton and were ¼" in length. A single score line 21 extended outwardly in each direction from the vertical score lines 12. There was no score line in the laminated portion of the sealing joint.

Figure 18:
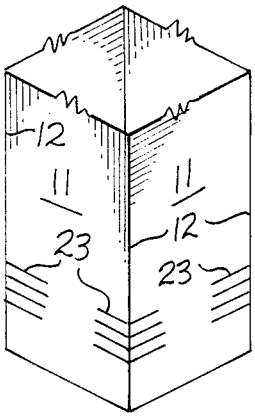

The third test design was a carton having the design shown in the Arslanian patent. The bottom section of the Arslanian design is shown in FIG. 18. In the test cartons the bottom score line 23 was placed $\frac{7}{8}''$ above the bottom of the carton. Four score lines 23 were used at each location. The score lines 23 were $\frac{1}{2}''$ long and $\frac{1}{8}''$ apart.

These score line locations and the score line length were in the range disclosed in the Arslanian patent. The Arslanian patent requires the height of the score lines to be between 10% and 25% of the height of the side panels. This required a height between 0.74" and 1.84" in the cartons being tested. The height of the score lines in the test cartons was from 0.875" for the lowest score line 23 to 1.25" for the upper score line 23. Claims 2 and 5 stated that the score lines were at least 4 in number and 4 score lines were used in the test cartons. Claims 2 and 5 indicated that the score lines were $\frac{1}{8}''$ apart and the score lines 23 were $\frac{1}{8}''$ apart in the cartons. The claims required that the length of the score line be between 10% and 25% of the width of the side panels. This was between 0.28" and 0.69" in the cartons being tested. A score line length of $\frac{1}{2}''$, intermediate these lengths, was used in the test cartons.

Figure 19:
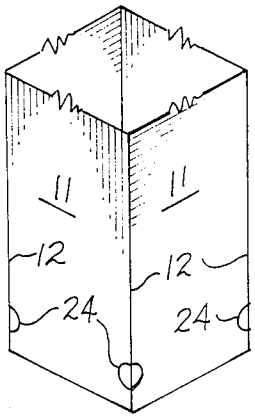

The fourth test design used circular scoes. The bottom section of the carton with these scores is shown in FIG. 19. These are $\frac{1}{4}''$ diameter circles 24 centered on the vertical score lines 12 and $\frac{1}{4}''$ above the carton bottom. This design was devised for these tests. It was used to determine the difference between a pair of score lines intersecting the vertical score line and a single score line intersecting the vertical score line.

The board used for all the cartons in the tests was a three ply board having a low density core and higher density outer plies. There was a polyethylene coating on both sides of the board. Quartz size containers were used for the test.

The depth of the score lines in the sample were normal (0.005–0.007"). The cartons were sealed on a commercial sealer. A cartons were filled with a red dyed water for tests. This allowed any cracks or fissures in the container walls to be seen more easily.

Two tests were used. A drop test was used to simulate the sudden impact for which the present bumper score lines were developed. A vibrating table test was used to simulate the continuous vibrations for which the Arslanian design was developed.

In the drop test the carton is dropped through a tube onto a surface. Three heights are used. These are 12", 15" and 18". 24 cartons are dropped from each height. Each of the cartons is then examined for damage at the lower corners.

The results of the drop test are given as a rating index. The rating index is a combination of failure numbers and the severity of failure. A lower index number indicates fewer or less severe failures. Each bottom corner of the container is rated separately on a score of 0 to 3. Zero indicates no failure in a bottom corner of the container. One indicates the failure of the bottom corner of the container to be slight. Two indicates the failure of the bottom corner of the container to be medium. Three indicates the failure of the bottom corner of the container to be severe. The total rating for the container can be between 0 and 12. As an example a rating of three would indicate that one bottom corner failed severely, or one bottom corner failed somewhat and one bottom corner failed slightly, or three bottom corners failed slightly.

Figure 20:
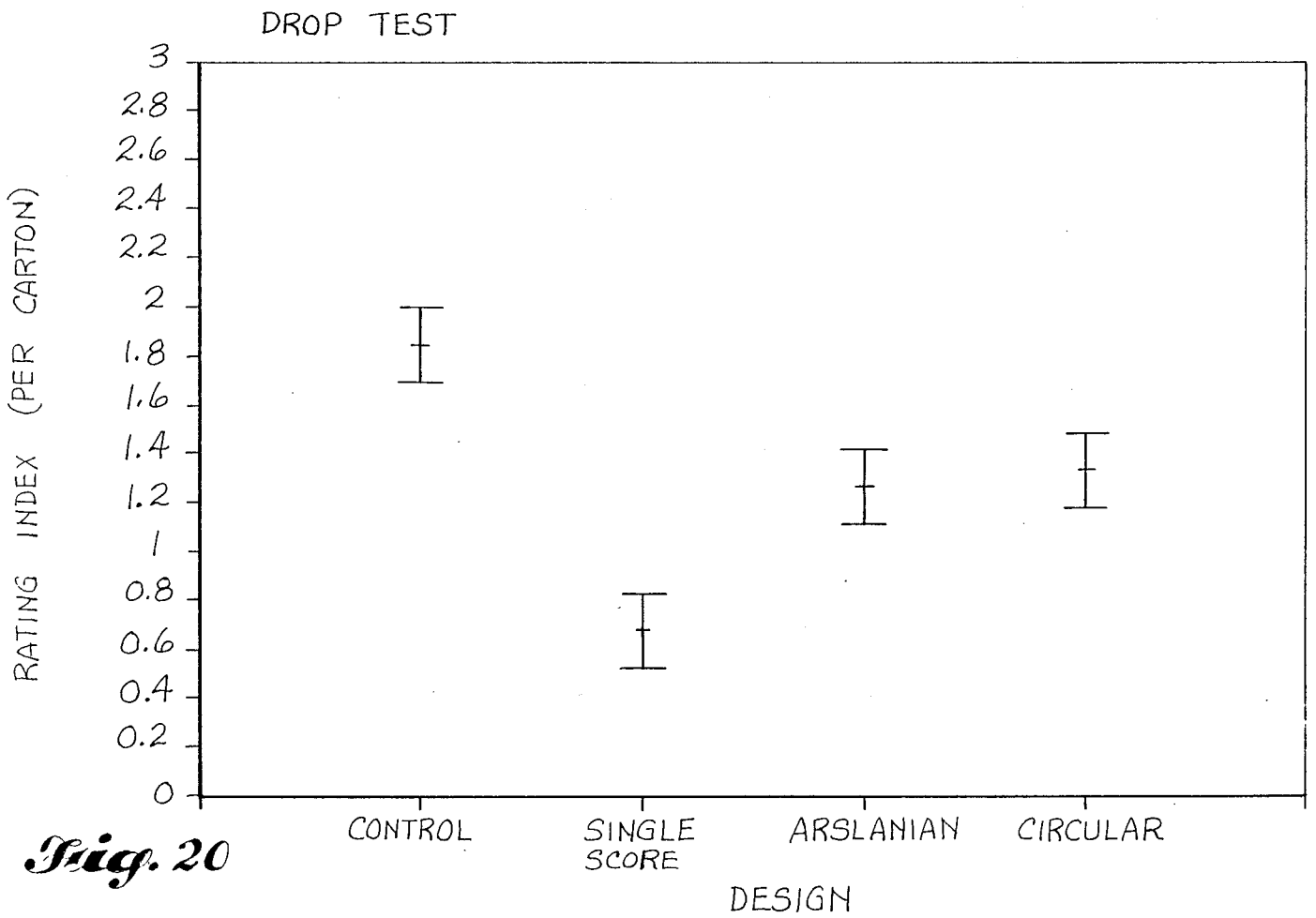
FIGS. 20 and 21 are graphs showing the results of the tests.

The results of the drop test are listed in Table I and plotted in FIG. 20. In FIG. 20 the bands around the data are the 95% least significant difference confidence bands. These bands indicate no statistical difference if the bands overlap and a significant difference if the bands do not overlap.

The reduction in the Rating Index and in corner fractures is significant when the Present Invention is compared to the control and the two other designs. The present invention reduced severity failure to $\frac{1}{3}$ that of the unscored control, more than $\frac{1}{2}$ of the circular score design and $\frac{1}{2}$ of the Arslanian design. This indicates that the single score line intersecting the vertaical score above the bottom of the carton significantly reduces the sudden impact failure rate when compared to multiple score lines intersecting the vertical score line.

TABLE I

DROP TEST RESULTS

| Scoring Type | Rating Index | Percent Reduction |
|---|---|---|
| Control | 1.85 +− 0.15 | — |
| Circular scores | 1.35 +− 0.15 | 27% |
| Arslanian | 1.25 +− 0.15 | 32% |
| Present Invention | 0.65 +− 0.15 | 65% |

The vibrating table test was a severe test designed to promote leaking containers. It is not representative to the vibration that a container would be subject to in normal plant and road transportation. All of the containers were subject to the same number of vibrations over the same time period. The resuslts of the vibrating table test are given as a percentage of cartons that leaked.

Figure 21:
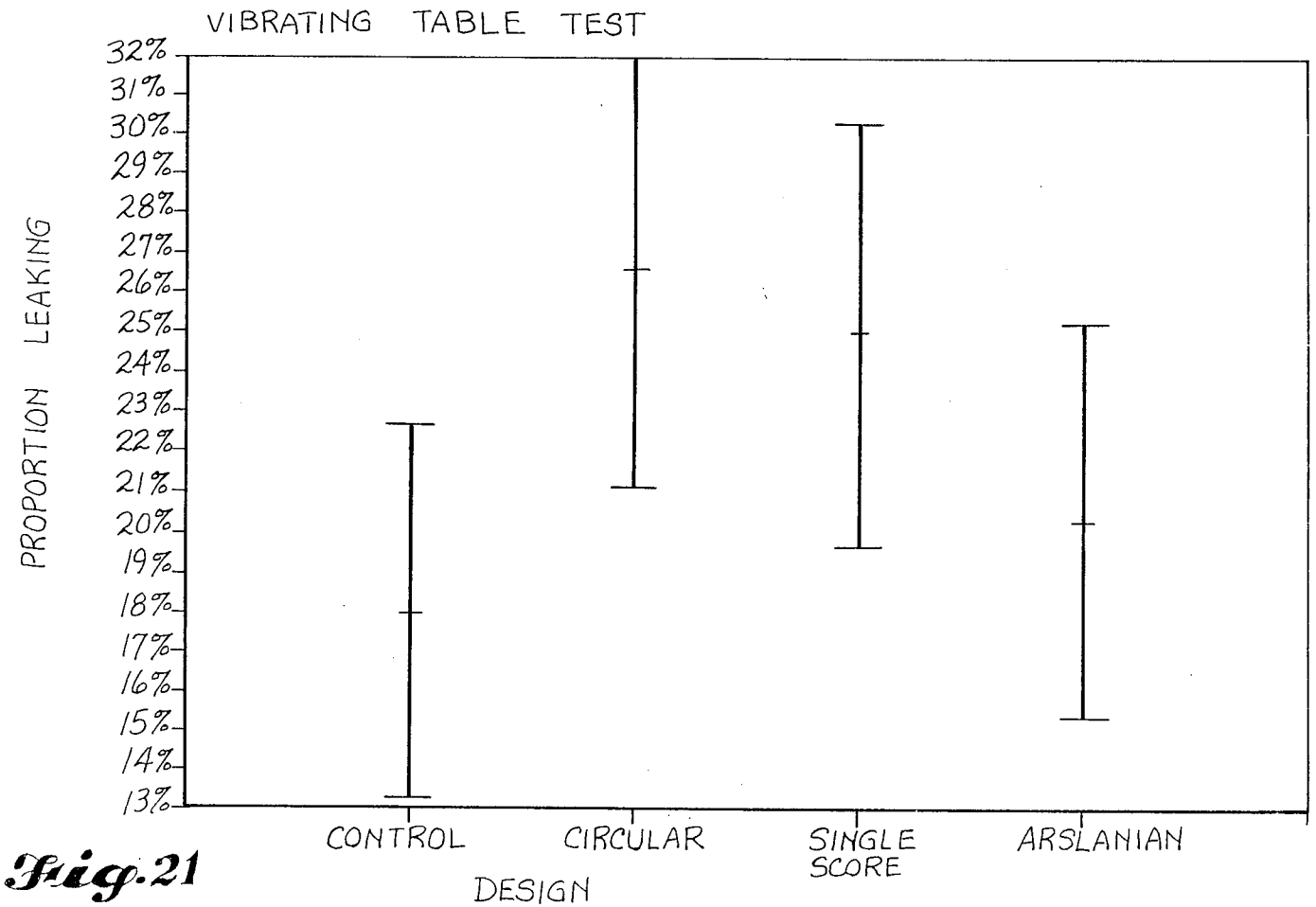

These results are listed in Table II and plotted in FIG. 21. Again, the bands around the data are the 95% least significant difference confidence bands. These bands indicated no statistical difference if the bands overlap and a significant difference if the bands do not overlap.

TABLE II

VIBRATING TABLE TEST RESULTS

| Scoring Type | Percent Leakers | Difference |
|---|---|---|
| Circular scores | 26.5 +− 5.5 | NSD |
| Present Invention | 25.0 +− 5.5 | NSD |
| Arslanian | 20.5 +− 5.0 | NSD |
| Control | 18.0 +− 4.5 | NSD |

NSD = No significant difference

In the vibrating table test the three scored designs failed at higher rates than the unscored control but there was no significant statistical difference among any of the four designs tested in the vibratory table test. This is interesting because the purpose of the Arslanian design was to improve the carton against continuous vibration during movement in the plant and transportation from the plant.

However, there is a statistical difference in the drop test between the present invention and each of the Arslanian design, the circular score line design and the unscored control. This means that the present invention will withstand dropping more than the other designs, a significant advantage in many markets where dropping of liquid containers is a problem. At the same time, the present invention is comparable to the other designs in preventing damage during transportation.

We claim:

1. A unitary blank for a paperboard carton comprising side panels attached to each other along first parallel score lines, bottom panels attached to said side panels along a second score line transverse to said first score lines, a series of third score lines in said side panels and extending outwardly from each of said first score lines, there being no more than one said third score line extending outwardly in a direction from each said first score line, each of said third score lines being of a length and its intesection with said first score line being spaced from said second score line a distance which will preferentially cause any fold formed in the carton wall because of a sudden impact to occur at the intersection of one of the third score lines and one of the first score lines instead of a carton bottom corner defined by the second score line and one of the first score lines.

2. The blank of claim 1 in which said third score lines are parallel to said second score lines.

3. The blank of claim 1 in which said third score lines extend at an angle to said second score lines.

4. The blank of claim 1 in which said third score lines are curved.

5. The blank of claim 1 in which said third score lines have a length of at least $\frac{1}{8}''$.

6. The blank of claim 1 in which said third score lines have a length of at least $\frac{1}{4}''$.

7. The blank of claim 1 in which said third score lines have a length in the range of $\frac{1}{8}''$ to $\frac{1}{2}''$.

8. The blank of claim 1 in which the intersection of each of said third score lines and said first score lines is spaced from said second score lines a distance in the range of $\frac{1}{8}''$ to $\frac{1}{2}''$.

9. A paperboard carton comprising side panels attached to each other along first parallel score lines and forming a tubular container, a bottom wall attached to said side panels along a second score line transverse to said first score lines, a series of third score lines in said side panels and extending outwardly from each of said first score lines, there being no more than one said third score line extending outwardly in either direction from each said first score line, each of said third score lines being of a length and its intersection with said first score line being spaced from said second score line a distance which will preferentially cause any fold formed in the carton wall because of a sudden impact to occur at the intersection of one of the third score lines and one of the first score lines instead of a carton bottom corner defined by the second score line and one of the first score lines.

10. The carton of claim 9 in which said third score lines are parallel to said second score lines.

11. The carton of claim 9 in which said third score lines extend at an angle to said second score lines.

12. The carton of claim 9 in which said third score lines are curved.

13. The blank of claim 9 in which said third score lines have a length of at least $\frac{1}{8}''$.

14. The blank of claim 9 in which said third score lines have a length of at least $\frac{1}{4}''$.

15. The carton of claim 9 in which said third score lines have a length in the range of $\frac{1}{8}''$ to $\frac{1}{2}''$.

16. The carton of claim 9 in which the intersection of each of said third score lines and said first score lines is spaced from said second score lines a distance in the range of $\frac{1}{8}''$ to $\frac{1}{2}''$.

* * * * *